US006231671B1

(12) United States Patent
Ciliske et al.

(10) Patent No.: US 6,231,671 B1
(45) Date of Patent: May 15, 2001

(54) FLOATING COATING DIE MOUNTING SYSTEM

(75) Inventors: Scott L. Ciliske, St. Paul; Luther E. Erickson, Stillwater, both of MN (US); Gary W. Maier, Warren Township, WI (US); Bruce J. G. Wahoski, Coon Rapids, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/185,698

(22) Filed: Nov. 4, 1998

(51) Int. Cl.[7] ..... B05C 3/02
(52) U.S. Cl. ..... 118/410; 118/419
(58) Field of Search ..... 118/410, 419, 118/681, 672; 427/356

(56) References Cited

U.S. PATENT DOCUMENTS

| | | |
|---|---|---|
| 3,595,203 | 7/1971 | Fabulich . |
| 3,609,810 | 10/1971 | Coghill . |
| 3,854,441 | 12/1974 | Park . |
| 4,245,582 | 1/1981 | Alheid et al. . |
| 4,503,804 | 3/1985 | Damrau . |
| 4,520,049 | 5/1985 | Nakanishi . |
| 4,675,230 | 6/1987 | Innes . |
| 4,889,072 | 12/1989 | Krimsky . |
| 5,417,181 | 5/1995 | Idstein et al. . |
| 5,540,779 | 7/1996 | Andris et al. . |

FOREIGN PATENT DOCUMENTS

| | | |
|---|---|---|
| 0 441 425 A1 | 8/1991 | (EP) . |
| 0 571 849 A1 | 12/1993 | (EP) . |
| 1190324 | 5/1970 | (GB) . |
| WO 96/15860 | 5/1996 | (WO) . |

OTHER PUBLICATIONS

Japanese Abstract, vol. 011, No. 369 (JP 62 140670 A), Dec. 2, 1987.

*Primary Examiner*—Brenda A. Lamb
(74) *Attorney, Agent, or Firm*—Carolyn V. Peters

(57) ABSTRACT

An adjustable mounting system for premetered contact coating dies includes a base and a die-receiving portion movably connected to the base. During coating, the die can float a distance from the surface being coated based on the balance of forces between the die and the coated surface. This creates a variable separation gap and allows automatic self-compensating for variations in web or fluid properties. This, in turn, optimizes the coating characteristics. The mounting system can also include an enclosure for protecting its components.

10 Claims, 5 Drawing Sheets

FLOATING COATING DIE MOUNTING SYSTEM

TECHNICAL FIELD

The present invention relates to coating dies. More particularly, the present invention relates to supports for coating dies.

BACKGROUND OF THE INVENTION

Coating dies are well known, and there are many variations. One typical coating die includes an upstream bar and a downstream bar connected together. An upstream die lip is part of the upstream bar, and a downstream die lip is part of the downstream bar. A manifold is formed in one or both bars and leads into a slot which exits the die at the lips of the die. Coating fluid is supplied through a channel to the manifold for distribution through the slot and coating onto a moving web or other surface to be coated. The coating fluid can form a continuous coating bead among the upstream die lip, the downstream die lip, and the surface being coated (such as a moving substrate or web). The coating fluid can be one of numerous liquids or other fluids. A vacuum chamber can apply vacuum upstream of the bead to stabilize the coating bead. The coating fluid can be applied to the web in a free span or against a backup roller.

A wide range of fluids are applied to surfaces using various coating dies. The coating dies themselves are modified for a specific application to optimize the coating of fluid on the surface. Varying other external features, such as the hardness of backup rolls, can also optimize coating. Within a given die configuration, the coating quality can be changed drastically by making small angle changes and height changes between the coating die parting line and a radial line extending outward from the center of the backup roll. Still, uneven coating persists often due to such factors as rubber roll runout or straightness, web line vibration, web thickness and surface variations, nonlinearity of the die lips, and the need for a precise placement of the die lip on the web. Coatings are sometimes inconsistent across their width due to an unevenness of the cross web die pressure.

The mounting systems for the coating dies are also modified to optimize coating. Coating dies are mounted at a location, sometimes called the coating station, at which the coating fluid is to be applied to a surface. Known mounting devices are rigid or fixed. That is, the die is positioned and fixed at a precise location adjacent the surface to be coated to optimize coating. This location can be changed to accommodate various fluids and coating conditions. However, during coating, the die remains stationary on its mount.

In some cases, coatings are applied to the web without any supporting member on the web backside at the point of coating application. An example of this is mayer rod coating where the web is supported between two rollers and a coating rod is mounted such that the web partially wraps around the rod circumference. The coating uniformity is controlled by, among other things, the rod straightness, web wrap angle around the rod, overall web tension, and the point-to-point web tension uniformity. If there is bag in the web at any point, that part of the web will have heavier coating than an adjacent area without bag that has a higher corresponding web tension.

In a similar manner, a pre-metered coating die can be pressed against a web in a free span between two rollers. Assuming that the coating die is designed properly for the coating liquid and provides a perfectly uniform crossweb distribution without the web in place, the final coating uniformity is a function of the localized web tension. A high web tension in one area of the die will cause the liquid to move towards an area having a lower localized web tension. Lower localized web tension in coating areas have higher coating thicknesses and higher tension areas have lower coating thicknesses. In extreme cases, the web tension will dominate the coating quality and cause skips and streaks.

U.S. Pat. No. 3,854,441 teaches using a press roll to apply force from the backside of the web against the die lips and the fluid exiting the die slot. Pneumatic cylinders provide pressure against the web and lift the press roll away from the web. However, very light pressures can not reliably be obtained because of friction in pneumatic cylinders sized to lift the weight of the roll.

GB Patent Publication No. 1190324 illustrates the use of a flexible blade to apply pressure between the web and the coating die. This is capable of very low pressures depending upon the flexibility of the blade. However, the blade rubs against and may scratch the web.

U.S. Pat. No. 3,609,810 discloses die coating where air lift bellows push and hold in position the die and its knife bar in close proximity to the web on a back-up roll. The gap between the die lip is fixed by pushing the die and the mounting fixtures against stops which may be adjusted to adjust the gap. With this arrangement, if the back-up roll is not perfectly round the gap will vary with each revolution. Urging the die against fixed stops does not allow self-compensation for out-of-roundness. Nor does it compensate for variation of the web thickness which will vary the gap.

Streaking can be more common when using contact extrusion die systems (as compared to non-contact systems) to apply thin coatings or fluids. In contact extrusion coating, the die position depends on whether fluid is exiting the die. If no fluid passes through the die, the die would contact with the substrate. When fluid passes through the die and exits through the die slot, the fluid flow causes a hydrodynamic pressure that moves the die away from the substrate, thereby opening a gap between the die lip and the substrate. This gap is known as the separation gap.

This contrasts with the metering gap which is a set, fixed clearance between a coater component (such as a knife edge) and the web. It is set by adjusting and fixing the mounting before coating. Thus, even when no fluid is being applied, the gap is still there. When fluid is applied, the gap is still there.

There is a need for a mounting system for a contact die coater in which the separation gap can be adjustable during coating to maximize coating quality.

SUMMARY OF THE INVENTION

An adjustable mounting system for premetered contact coating dies includes a base and a die-receiving portion movably connected to the base. During coating, the die can float a distance from the surface being coated based on the balance of forces between the die and the coated surface. This creates a variable separation gap and allows automatic self-compensating for variations in web or fluid properties. This, in turn, optimizes the coating characteristics, by precisely varying the position of the die-receiving portion in the vicinity of the surface to be coated.

The die-receiving portion can be connected to the base by either a flexible member or a precision hinge member.

The movement of the die-receiving portion can be limited by a stop mechanism. The die can be permitted to float by pressing between the coating die and the base, pressing against the coating die, the die-receiving portion, and the flexible member, as well as pressing between the die-receiving portion and the base, pressing between the flexible member and the base, and pressing between the flexible member and the stop mechanism.

The base can include a lower portion and a leg portion, and the die-receiving portion can include a mounting portion and a leg portion rigidly connected to each other. The base leg portion can be generally parallel to the die-receiving portion leg portion. The die-receiving portion can also include a force-generating arm rigidly connected to the leg portion.

In another embodiment, the mounting system can also include an enclosure for protecting at least the flexible member and the fluid-loaded bladder used to position the die. The enclosure and the force-applying arm of the die-receiving member can each have openings to receive a fluid feed conduit for feeding fluid to the die. Alternatively, the die receiving portion can be shaped to shield the fluid-loaded bladder used to position the die and the flexible member by serving as an enclosure.

DETAILED DESCRIPTION

Figure 1:
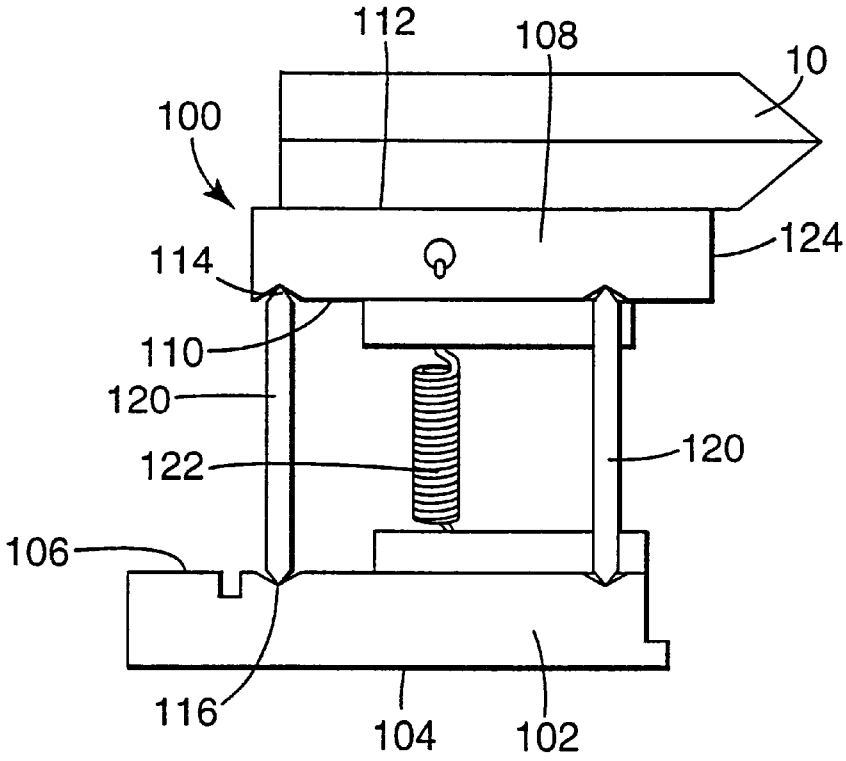
FIG. 1 is a side view of a mounting system of one embodiment of the invention.

The invention is a mounting system for premetered contact coating dies, such as extrusion and slot dies that apply a premetered amount of coating onto a surface. (This is contrasted with, for example, blade coating, which applies an excess of coating which is removed during the coating process.) The inventors have found that die mounts which position the coating die in the vicinity of the web (or other surface being coated), and in which the force of the die against the web can be precisely adjusted during coating, to significantly improve coating. The mounting system permits the die to float on the coating. The mounting system can reliably and repeatably position the die to apply a consistent force against the web.

In contact coating with the mounting system, the die position depends on whether fluid is exiting the die. As fluid exits through the die slot, the fluid flow causes a hydrodynamic pressure that moves the die away from the substrate, thereby opening a separation gap between the die lip and the substrate. The mounting system allows setting a desired pressure between the fluid coated on the web and the die by applying consistent low forces (based on the fluid rheology) to the die sufficient to coat a fluid on the web. The mounting system improves upon known systems in that it can "float." It allows the die to move toward and away from the web as variations in the web or in the coating fluid pass by the die. The die moves toward the web by the applied pressure from the mounting system and the die moves away from the web in reaction to forces from the coated web. This permits the applied coating to be more uniform and to achieve the desired characteristics.

In response to variations in the web location or web thickness (such as splices), the mounting system can move the die to adjust the force and yield the desired coating appearance. As the force of the die against the fluid changes, the web, whether supported or in free span, counteracts the die force to permit the die to float to apply the appropriate force against the web to yield the desired system equilibrium.

The mounting system can apply a consistent light force of approximately 15 to 30 gm/mm of die width against the web. This preload is held constant in response to variations such as web thickness, roll runout and machine vibrations that would disturb the gap between the die and the web. This allows an operator, while coating, to precisely oppose the hydrodynamic force created by fluid flowing through the gap that would otherwise further separate the die from the web. Maintaining this constant preload helps yield the desired coating appearance.

For a coating system, the applied fluid pressure can deform the substrate or the applicator. This alters the fluid flow, and changes the localized hydrodynamic pressure that acts on the web or the applicator. This competition between the hydrodynamic and the elastic restoring forces of the deformable walls of the channel that confine the fluid is described by the theory of elastohydrodynamics. (To develop a hydrodynamic pressure in free span, a die with the appropriate lip geometry is brought into contact with a tensioned web that bridges the gap between two parallel rollers. The contact point of the die must be wrapped by the surface and create ideal entering and leaving angles between the surface and the die slot. In this arrangement, web tension determines the elastic pre-load of the surface side of the converging channel and low or high tension lanes will affect the hydrodynamic forces and the appearance of the coating. In some cases, such as deformed webs where the edges or interior lanes show bagginess when the bulk of the web is tensioned and flat, it is difficult to create an acceptable coating across the full die width. This requires constantly adjusting some die parameters, such as penetration, attack angle, and span distance, to compensate.) The mounting system of the invention allows the die to seek a balanced position that stabilizes the competing forces between the fluid and the mounting system.

Because the die is relatively unresponsive to the hydrodynamic and elastic forces, the mounting system responds to only relatively low frequency disturbances to the balance of forces, such as trending changes in web caliper and fluid properties. To counter higher frequency disturbances, like roll run-out or machine vibrations, free spans of web or soft roll covers against which a web is coated can be used to comply and accommodate these changes. Soft rubber rolls reduce the impact of non-ideal lanes of tension in the web on coating quality. When coating against a metal backup roll, the coating reflected the backup roll surface imperfections. Like the web in free span, the roll cover is a low mass system that can quickly react to forces that lie in the frequency domain of disturbances that can manifest themselves as visible coating defects. Combining a floating die system and free span or soft rubber roll creates an optimum contact die coating system; one that compensates for both low and high frequency disturbances.

The adjustment of the die position by the mounting system can be performed by any known adjusting apparatus. Biasing devices, like springs, and other mechanical systems can be used. Pneumatics, including flexible, fluid-filled containers also can be used where the dampening of the fluid can be used to advantage. These systems can be used separately or together. Pneumatics allows maintaining the spring rate and the desired die force at a nearly constant value even as the stationary part of the mount moves. "Bladders" will be used to generically describe all pneumatic versions, such as tubes, and fluid-loaded diaphragms, which press the die lip against the moving web. Any fluid can be used, including air. "Flexible" includes both linear and torsional motion and is preferably elastic. As described, the "x direction" is the direction describing the coating thickness, a direction perpendicular to the web. The "y direction" is the direction describing the width of the web. The "z direction" is the direction describing the length of the web. The optimum dimensions, properties, characteristics, and materials of the various components of the mounting system depend on various other parameters such as the die size and mass, the fluid characteristics, the intended coating characteristics, and the web features.

FIG. 1 shows a parallel knife edge floating mount having three degrees of freedom (linear translation in the x and y directions and rotation about the z axis). One or more mounts can be used to support the die. In this system 100, a bottom, stationary plate 102 has a lower surface 104 and an upper surface 106. A top, moving plate 108 has a lower surface 110 and an upper surface 112. The die 10 is bolted or otherwise attached to the upper surface 112 of the top plate 108. That the bottom plate 102 is "stationary," means that it remains fixed during coating. It can move to a retracted position, such as for shutdown, and move to a coating position closer to the web for coating, but this movement does not occur during coating.

The upper surface 106 of the bottom plate 102 and the lower surface 110 of the top plate 108 each have a pair of V-shaped grooves 114, 116 respectively, in corresponding locations. A pair of parallel knife-edged plates 120 seat in the V-shaped grooves 114, 116 in the upper surface 106 of the bottom plate 102 and the lower surface 110 of the top plate 108. A tension spring 122 (or other biasing device) spanning the bottom and top plates 102, 108 helps keep the knife-edged plates 120 in contact with the corresponding grooves 114, 116. The die 10 can be pushed against the web using a biasing device (not shown in FIG. 1) such as a commercially available stiff-walled air-inflated rubber bladder, or an air-inflated flattened polyester tube. This design has very low inherent stiction (friction that tends to prevent relative motion between two movable parts at their null position). The mounting system 100 keeps the die 10 at a constant angle, and the die elevation changes slightly depending on where it is in the arc of its stroke. With this design the die angle can change only if the die reaction forces cause the knife-edged plates 120 to lose contact with their corresponding grooves 114, 116. These die reaction forces are generated by the viscous drag of the web on the coating fluid which transmits the force to the die body and will cause the die lip to tend to move in the same direction as the web.

Figure 2:
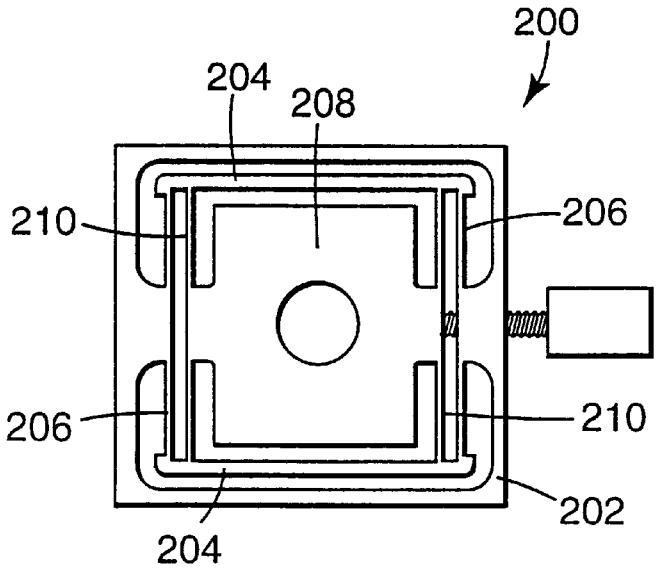
FIG. 2 is a top view of another mounting system of the invention.

Another embodiment of the mounting system 200, shown in FIG. 2, is a compound flexure stage system having one degree of freedom. In this design, a series of flexible members, such as shim stock plates, are located between the stationary, intermediate and movable members. Alternatively, links with precision hinges can be used instead of the flexible members. For example, bronze bushings or ball bearings can be used.

The system 200 includes a base 202 which is fixed. An intermediate member 204 is connected to the base 202 by two flexible members 206. A moving member 208 is connected to the intermediate member 204 by two additional flexible members 210. This system 200 allows translation along one axis while being rigid enough to prevent translation along the other two orthogonal axes or any rotation. The overall stiffness of the unit can be adjusted by changing the thickness, length, or material of the flexible members. It can be operated with or without force generated by a pneumatic device. When using a rubber tube to increase the overall spring constant of the device, the operating position of the stationary part of the mount becomes more critical. This is because uniform increments of movement of the stationary reference position toward the web generate ever increasing increments of force between the die and the web.

Figure 3:
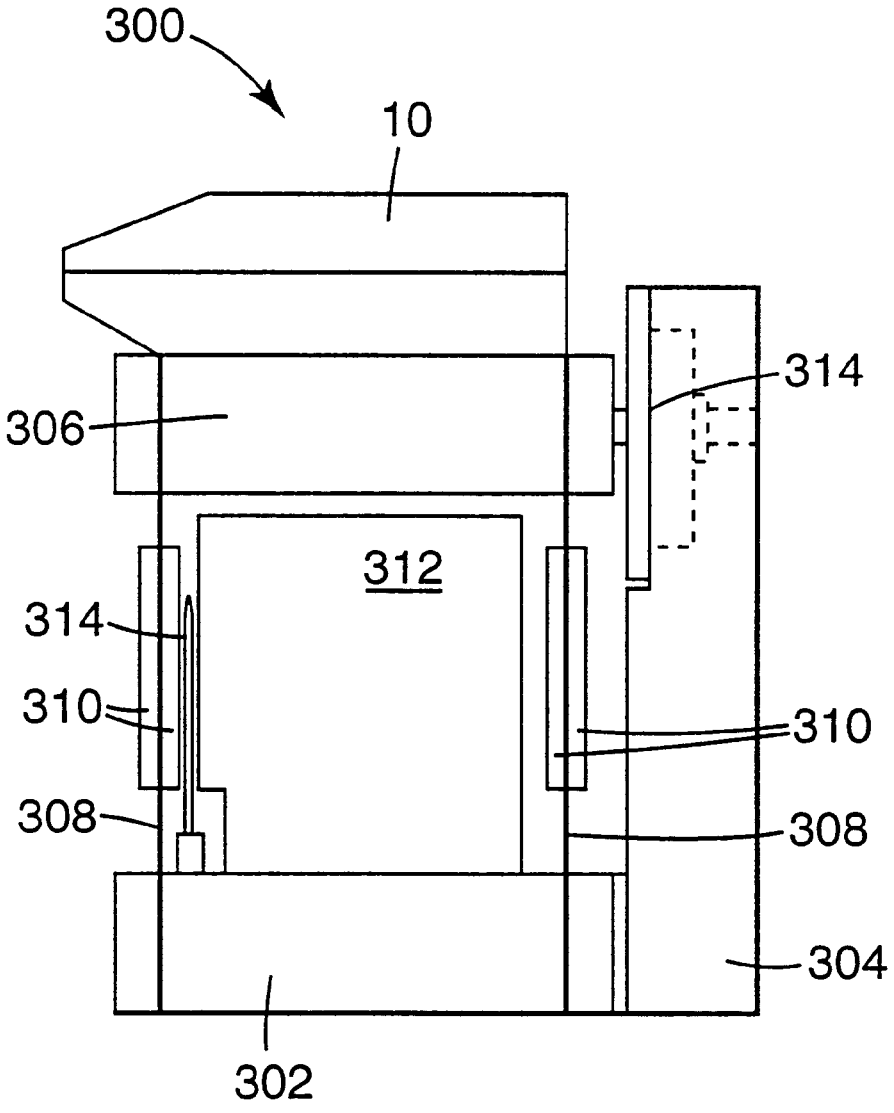
FIG. 3 is a side view of another mounting system of the invention.

FIG. 3 shows a simple flexure stage floating mounting system having two degrees of freedom (linear translation in the x and y directions). This embodiment is similar to that of FIG. 1, but vertical flex members are used instead of knife edged plates. This mounting system 300 includes a bottom, stationary plate 302 fixed to a side stationary support 304. A top, moving plate 306 receives a die and is connected to the bottom, stationary plate 302 by at least two vertical flex members 308. The middle of each flex member 308 can be clamped between a pair of thicker clamp plates 310 to prevent buckling. Stainless steel shim stock 0.0254 cm (0.010 in) to 0.0762 cm (0.030 in) thick can be used as the flex members 308. Thicker material also can be used.

A stationary block 312 is mounted on the bottom, stationary plate 302 between the two vertical flex members 308. The stationary block 312 serves as a stop to restrict movement of the clamp plates 310 and the top plate 306. Other mechanical stops can be used.

At least one fluid bladder 314 is used to adjust the die 10 position. One or more bladders 314 can be located between clamp plate 310 closer to the web and the stationary block 312, or between the clamp plate 310 farther from the web and the side stationary support 304. As shown, the bladder 314 is located adjacent the clamp plates 310 at the side opposite the side stationary support 304. This is the same side as the die face. In this position, increasing the bladder pressure moves the flex members 308 and the clamp plates 310 to move the top plate 306 and the die 10 toward the surface being coated. The bladder 314 (which is 0.005 cm (0.002 in) to 0.008 cm (0.003 in) thick) had a width of slightly more than 1.27 cm (0.5 in) when flattened and can be ultrasonically bonded along its major axis with a lap joint. The end also can be ultrasonically sealed when the tube is flattened.

If the center of pressure of the bladder 314 is at the midpoint between the lower and upper flex points of the flex members 308, the force generating arm is about half the length of the arm forcing the die against the web. Thus, the force available to press the die against the web, due to the "lever arm ratio" was about half that generated at the bladder 314. This lever arm ratio is the effective length of the force-generating arm divided by the length between its lower flex point and its top flex point (if there is one) or the die centerline.

In a modification, a bladder 314 can be located between the side stationary support 304 and the top plate 306. Inflating the bladder 314 to increase its size moves the top plate 306 and the die 10 toward the surface being coated. The bladder 314 was placed with its major axis in a horizontal plane between the lower right vertical surface of the die 10 and the side stationary support 304. The minor axis was vertical. This generated adequate die loading for successful coating at pressures above 50 cm (20 in) to 77 cm (30 in) water. As the gap between the surfaces on each side of the bladder increased, the minimum required inflation pressure to achieve good coating also increased due to the reduced contact area of the bladder and the adjoining surfaces.

In another modification, multiple flex members 308 can be used. When multiple flex members are clamped adjacent each other, there is stiction in the mounting movement, due to the sliding friction force of the flex members 308 against each other. If the die 10 is excited into unwanted movements that do not mimic the web position, the sliding friction from the small relative shear movement between adjoining flex members 308 can accommodate the die movements. With a bonded viscoelastic layer of material between adjoining flex members, changing the position of the viscoelastic material will also change the degree of dampening.

The flex members 308 can be pieces of Esterlam brand doctor blade material (Esterlam International Limited, Ivybridge, Devon, United Kingdom) 0.061 cm (0.024 in) thick. Other than a light force due to the deflection of the flex members, pressurized fluid (such as air) provides the die loading force. The die height changes slightly as it moves through its range of travel, defined by the arcs of the flex members and the left and right clamp plates. The die angle remains almost constant in this embodiment. A slight angle variation was generated by the left clamp plate being shorter to provide space for a fitting connecting the fluid bladder to the lower pressure connection.

In other modifications, the bladder 314 can be a section of gum rubber tube of 0.64 cm (0.25 in) outside diameter and 0.30 cm (0.12 in) inside diameter, located between the side stationary support 304 and the top plate 306. Because the die force was nonlinearly related to the tube compression by the stationary support, the stationary support position became much more important. Alternatively, the bladder 314 can be a small automotive carburetor accelerator pump diaphragm with an effective diameter of about 2.8 cm (1.1 in).

The die loading force can be generated by a single continuous linear member such as a bladder or multiple discrete low friction devices placed along the die length. Similarly, the die support may be a single unit or multiple units, as desired, for the die length. Also, when a coating die is supported by a low friction mount that is actuated with small forces, the flexible liquid feed supply to the die can create unwanted forces that can either add to or subtract from the actuation force. The design of an effective system should carefully locate the feed hoses to prevent unwanted variability of the die force against the web.

Figure 4:
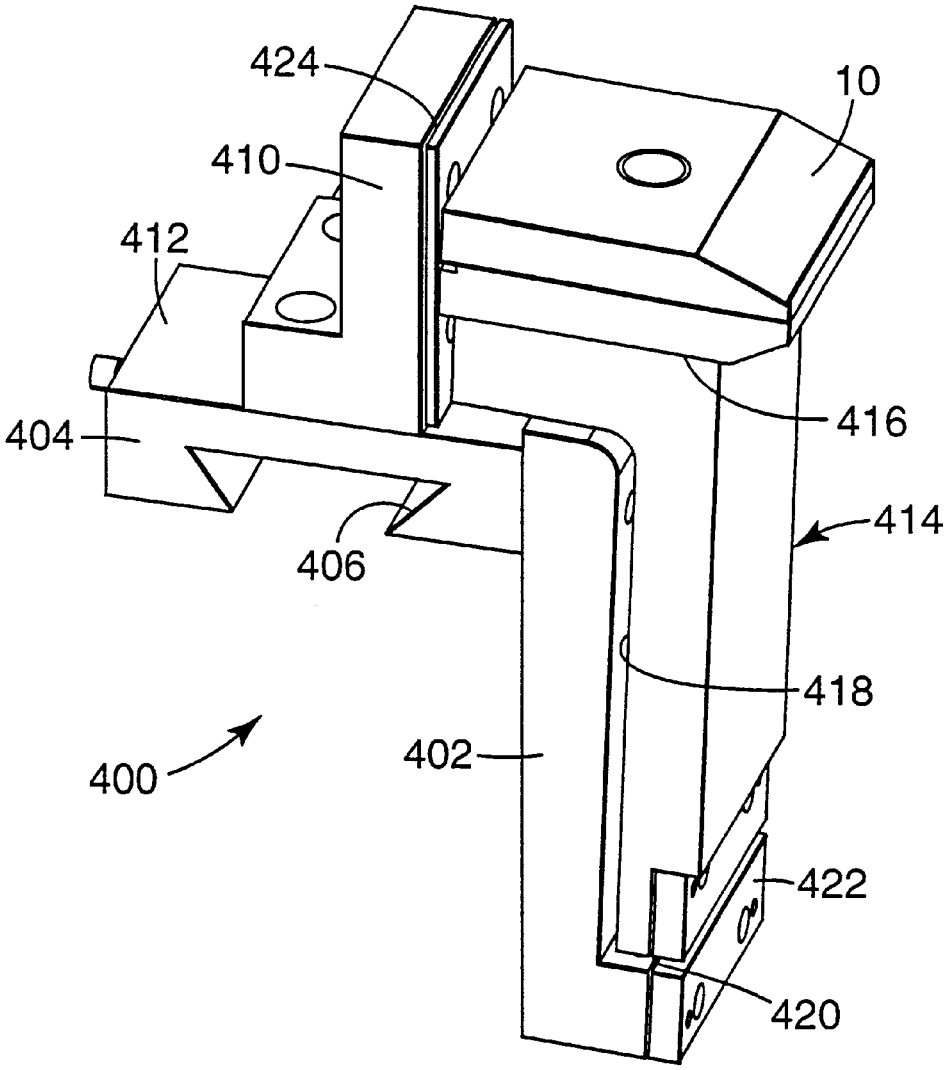
FIG. 4 is a perspective view of another mounting system of the invention.

A swing arm floating mounting system 400 having three degrees of freedom is shown in FIG. 4. In this embodiment, a fixed arm 402 is fixed to a slide 404. The slide 404 has a dovetail cutout 406. One or more slides 404 can be adjustably located at various locations along a rail (not shown) to position dies 10 in desired transverse locations to coat a surface. A bladder mount 410 is fixed to a top surface 412 of the slide 404. A swing arm 414 is pivotably mounted to the fixed arm 402. The swing arm 414 has a top surface 416 which receives a coating die 10 and a perpendicular surface 418 which faces the bladder mount 410. As shown, a flex member 420 connects the swing arm 414 to the fixed arm 402. The flex member 420 can be 0.0254 cm (0.010 in) thick stainless shim stock clamped between vertically separated clamp plates 422 0.3175 cm (0.125 in) apart. Bladders 424 can be located at any point between the swing arm 414 and the fixed arm 402, and between the bladder mount 410 and either the swing arm 414 or the coating die 10.

The coating die 10 is mounted on the top surface 416 of the swing arm 414. The pivot point of the swing arm 414 is about 14 cm (5.5 in) below the die parting line. In one configuration, the mount is set with the die 10 contacting the web at about the midpoint of the swing arm 414 stroke. The die can ride over splices and wrinkles in the surface being coated. From the midpoint of the stroke, the die angle changes about +/−0.9°. Different bladders 424 were used: a polyester tube bladder was located in four different locations, a gum rubber tube in several locations, and an accelerator pump diaphragm in two locations.

In one version, a polyester tube had a lower end near the flex plate and extended upward for about 10 cm (4 in) between the fixed arm and the adjacent side of the swing arm. This required higher air loading pressures because the lever arm ratio was about 0.36. With the bladder positioned horizontally, parallel to the die lips between the fixed arm and the swing arm just below the top of the fixed arm, the die coated effectively at a lever arm ratio of about 0.72. With the bladder located between the die 10 and the bladder mount 410, its major axis was parallel to the die lips. The effective lever arm ratio was close to 1.0 and continuous coating could be achieved at lower minimum pressures.

Using the horizontal gum rubber tube, longer or shorter pieces of tubing changed the tube spring constant and the generated force for the same deflection. This made the position of the fixed arm more important, because the force generated on the coating die was nonlinearly related to the compression of the tube. The tube was also located between the bladder mount 410 and either the die 10 or the top of the swing arm 414. Metal or polymer springs placed between the fixed arm 402 and the swing arm 414 can accomplish the same function. The spring function could also be combined into the flex member 420 by making it with a higher spring constant. These approaches increase the importance of the relative position of the swing arm to the stationary member. When the flex member contribution to the overall force is kept small, the low friction actuator becomes the dominant mechanism for producing consistent coating force against the die and a pressure setting to the actuator is easily quantified.

To examine the effect of allowing the die to rotate about a vertical axis, the standard flex clamp plates with a uniform gap between them were replaced with a pair that had the same gap in the center, with the gap increasing linearly to each edge of the flex member. The reduced constraint at the edges permitted the die to rotate side-to-side with very little force. This may be useful if the surface presented to the die for coating is out of parallel with the fixed arm or stationary support.

Figure 5:
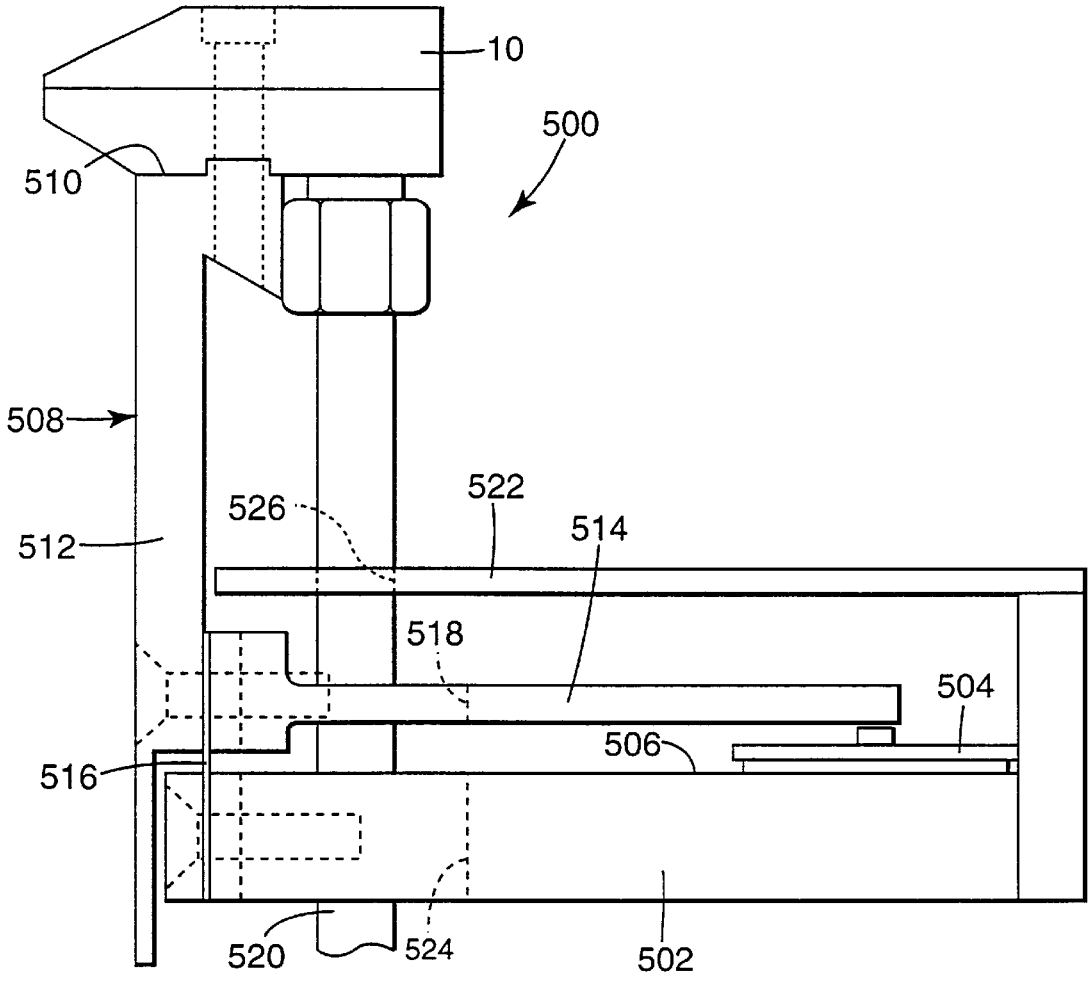
FIG. 5 is a side view of another mounting system of the invention.

FIG. 5 is a modification of the swing arm system of FIG. 4. In this embodiment, a fixed arm 502 can be fixed to a slide. A bladder 504 is mounted on the top surface 506 of the fixed arm 502. A swing arm 508 is pivotably mounted to the fixed arm 502. The swing arm 508 has a top surface 510 which receives a coating die 10 and a perpendicular, elongate portion 512. It also includes a force-generating arm 514, which is perpendicular to the elongate portion 512. The force-generating arm 514 is rigidly connected to the elongate portion 512 and a flex member 516 connects the swing arm 508 to the fixed arm 502. The location of the flex member 516 is shown as between the elongate portion 512 and the force-generating arm 514. As the bladder 504 pressure increases it moves the force-generating arm up in FIG. 5 and this pivots the elongate portion 512 toward the left to adjust the die.

An opening 518 in the force-generating arm 514 allows the fluid feed hose 520 (or other conduit) to pass through and reach the die 10 to feed fluid to the die. The fixed arm 502 is surrounded by an enclosure 522. The enclosure 522 prevents unwanted production environment material and other debris from interfering with the mounting system. The fixed arm 502 and the enclosure 522 also have openings 524, 526, respectively, which permit the feed hose 520 to pass through. The gap between the swing arm 508 and the enclosure 522 could be sealed with rubberized fabric to prevent rigid or viscous material from lodging in the gap and degrading long term operability. Similarly, any gap between the feed hose and the opening 526 in the enclosure 522 should be sealed. (Alternatively, the opening 526 can be larger and a sealing tube can connect the enclosure 522 and the fixed arm 502 to prevent spilled material from contacting the various components of this system 500.) This design has a lever arm ratio of about 0.85. The minimum loading pressure to achieve continuous coating was comparable to previous examples.

Figure 6:
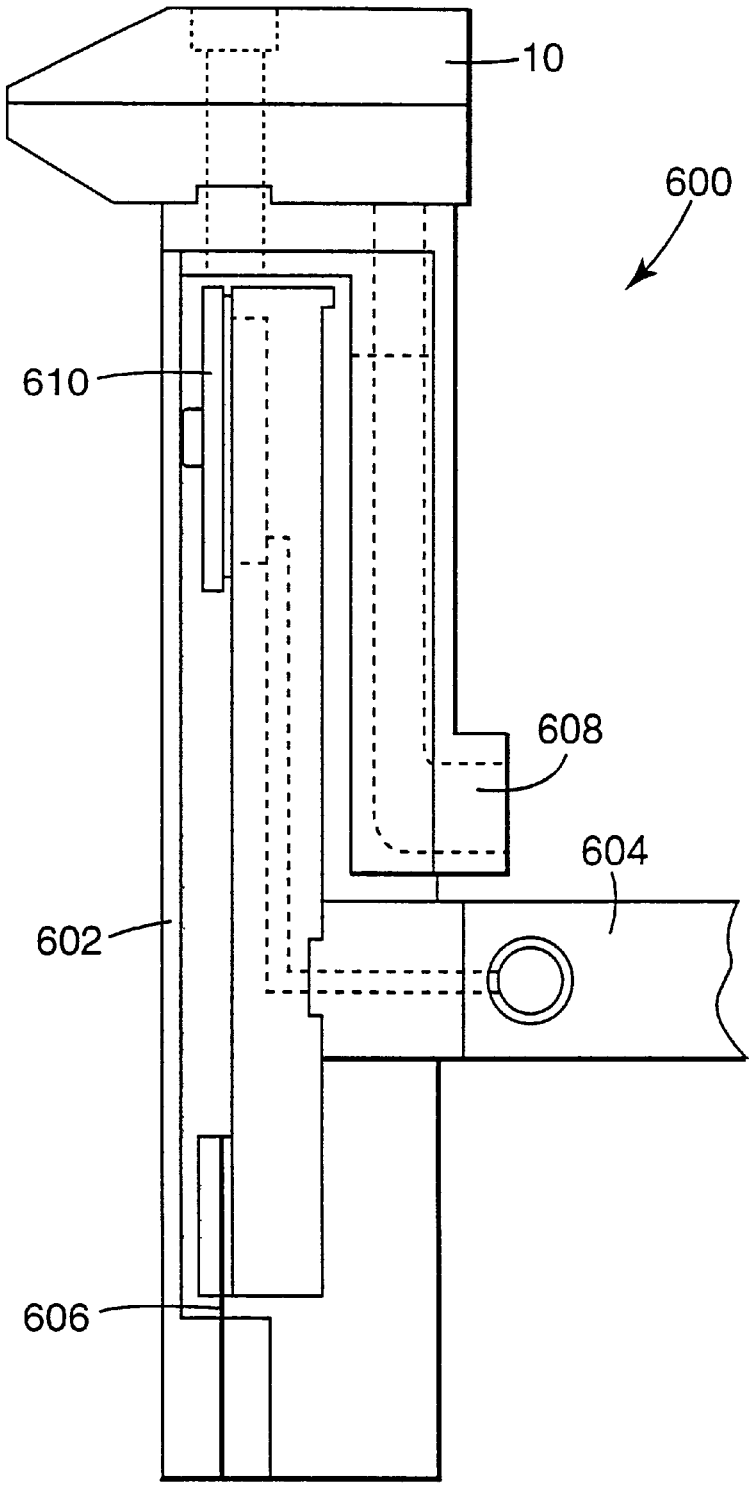
FIG. 6 is a side view of another mounting system of the invention.

In FIG. 6, the mounting system 600 is enclosed by an enclosure 602. In this embodiment, the entire enclosure serves as the moving member. The enclosure 602 is connected to a stationary member 604 by a flexible member 606. The bladder 610 located near the top of the stationary member 604 adjacent the die 10 has a lever arm ratio of approximately 0.72. The enclosure protects the fluid feed hose 608 as well as the fluid bladder 610 and prevents unwanted production environment material and other debris from interfering with the movement of the die.

The feed hose 608 delivering fluid to the coating die 10 can add or subtract force from the mount or twist the flex member 606. This is due to the connection internal pressure, location, stiffness, orientation, tension along its length, and centerline path and creates an unknown force on the die. This can be reduced by fastening the hose 608 to the enclosure 602 closer to the flex member 606, reducing the effective lever arm length for the feed hose 608. Also, fastening the other end of the feed hose 608 further from the die 10 reduces the likelihood that bumping or other mechanical upsets will affect the coating quality.

A further modification to the bladder design is to use dual bladders concentrically mounted to an axis perpendicular to the swing arm. The bladders can be clamped at their outer periphery to the fixed base and separated by a spacer ring. A stepped center plug is located at the inner periphery of each bladder. Introducing pressurized fluid between the diaphragms creates a driving force toward the side with the bladder of the larger area to move the swing arm.

For the swing arm systems, the center of mass of the coating die and mount is located roughly along a vertical line above the flex member. When coating against a roll at the horizontal tangent point, the die force against the web will be influenced only slightly by the horizontal offset between the mass center and flex member. If the coating assembly is rotated counterclockwise around the roll surface, the die and swing arm assembly mass center horizontal offset from the flex member will increase, adding the die-mount mass to the force at the die lip. Conversely if the coating assembly is rotated clockwise around the roll surface, the die and swing arm mass center will be to the right of the flex member and the die-mount mass will subtract from the force generated by the bladder. To varying degrees this is true for the other mounting systems. The same is true for free span coating.

The flex members in the designs described are largely in compression. A thinner flex member would have an increased tendency to buckle. Loading the flex members in tension such as when the stationary member is above the coating die will eliminate the tendency to buckle and would reduce the influence of the flex member spring constant on the die force.

Each mounting system has different features that are appropriate for different coating conditions. Restricting degrees of freedom reduces dynamic interactions. This reduces the complexity, increases robustness, and matches the dynamics of the mount to that of the coating system. The knife edge mounting system of FIG. 1, has three degrees of freedom, and has very little stiffness and springiness to resist motion or dampen vibrations. The compound flexure mounting system of FIG. 2 has only one degree of freedom, no moving bearing surfaces to wear, and inherent spring, mass, and damper parameters that could be selected to dampen vibrations. The flexure mounting system of FIG. 3, with two degrees of freedom and a simple design, is easy to construct from components. The swing arm mounting systems of FIGS. 4–6 eliminate one of the flexures. They can twist or rotate about the z axis and orient the die to the face of the web. The swing arm mount has three degrees of freedom, is simple and robust, and easy to manufacture.

Various changes and modifications can be made in the invention without departing from the scope or spirit of the invention. These die mounting systems can be modified by reducing their mass and by forming them as monolithic mounts machined from a single piece of metal or other material. Also, the mounting systems and the dies can be oriented in different positions depending on the coating setup. All materials cited in this disclosure are incorporated by reference.

What is claimed is:

1. An adjustable mounting system for premetered contact coating dies comprising:

a base;

a die-receiving portion connected to the base;

at least one of: a flexible member and a precision hinge member for movably connecting the die-receiving portion to the base; and means for, during coating, allowing the die to float a distance from the surface being coated based on forces between the die and the coated surface to create a variable separation gap and to allow automatic self-compensating for variations in surface or fluid properties to optimize coating characteristics, by precisely varying the position of the die-receiving portion in the vicinity of the surface to be coated.

2. The mounting system of claim 1 further comprising means for limiting the movement of the die-receiving portion.

3. The mounting system of claim 2 wherein the means for allowing the die to float during coating comprises means for pressing between at least one of: the coating die and the base, the die-receiving portion and the base, the at least one member for movably connecting the die-receiving portion to the base and the base, and the at least one member for movably connecting the die-receiving portion to the base and the means for limiting the movement of the die-receiving portion.

4. An adjustable mounting system for premetered contact coating dies comprising:

a base;

a die-receiving portion connected to the base;

two flexible members connected between the top of the base and the bottom of the die receiving portion;

means, located between the two flexible members, for limiting the movement of the die-receiving portion; and means for, during coating, allowing the die to float a distance from the surface being coated based on forces between the die and the coated surface to create a variable separation gap and to allow automatic self-compensating for variations in surface or fluid properties to optimize coating characteristics, by precisely varying the position of the die-receiving portion in the vicinity of the surface to be coated by at least one of: pressing against the coating die, pressing against the die-receiving portion, and pressing between one of the flexible members and the means for limiting the movement of the die-receiving portion.

5. An adjustable mounting system for premetered contact coating dies comprising:

a base, wherein the base comprises a lower portion and a base leg portion;

a die-receiving portion connected to the base, wherein the die-receiving portion comprises a mounting portion and a die-receiving portion leg portion rigidly connected to each other, wherein the base leg portion is generally parallel to the die-receiving portion leg portion;

means for movably connecting the die-receiving portion to the base comprising at least one flexible member connected between the base and the die-receiving portion leg portion; and means for, during coating, allowing the die to float a distance from the surface being coated based on the balance of forces between the die and the coated surface to create a variable separation gap and to allow automatic self-compensating for variations in web or fluid properties to optimize the coating characteristics, by precisely varying the position of the die-receiving portion in the vicinity of the surface to be coated.

6. An adjustable mounting system for premetered contact coating dies that coat surfaces comprising:

a base;

a die-receiving portion connected to the base wherein the die-receiving portion comprises a mounting portion, a leg portion rigidly connected to the mounting portion, and a force-generating arm rigidly connected to the leg portion;

means for movably connecting the die-receiving portion to the base comprising at least one flexible member connected between the base and the die-receiving portion leg portion; and means for, during coating, allowing the die to float a distance from the surface being coated based on forces between the die and the coated surface to create a variable separation gap and to allow automatic self-compensating for variations in surface or fluid properties to optimize coating characteristics, by precisely varying the position of the die-receiving portion in the vicinity of the surface to be coated by pressing against the force-generating arm to rotate the die-receiving portion.

7. The mounting system of claim 6 wherein the means for allowing the die to float during coating comprises a fluid-loaded bladder, and further comprising an enclosure for protecting at least the flexible member and the fluid-loaded bladder.

8. The mounting system of claim 7 wherein the enclosure and the force-applying arm of the die-receiving portion each have openings to receive a fluid feed conduit for feeding fluid to the die.

9. An adjustable mounting system for premetered contact coating dies that coat surfaces comprising:

a base;

a die-receiving portion connected to the base;

means for movably connecting the die-receiving portion to the base; and means for, during coating, allowing the die to float a distance from the surface being coated based on forces between the die and the coated surface to create a variable separation gap and to allow automatic self-compensating for variations in surface or fluid properties to optimize coating characteristics, by precisely varying the position of the die-receiving portion in the vicinity of the surface to be coated, wherein the die receiving portion is shaped to shield the means for allowing the die to float during coating and the means for movably connecting the die-receiving portion to the base from any fluid by serving as an enclosure.

10. An adjustable mounting system for premetered contact coating dies that coat surfaces comprising:

a base;

a die-receiving portion connected to the base;

means for movably connecting the die-receiving portion to the base; and means for, during coating, allowing the die to float a distance from the surface being coated based on forces between the die and the coated surface to create a variable separation gap and to allow automatic self-compensating for variations in surface or fluid properties to optimize coating characteristics, by precisely varying the position of the die-receiving portion in the vicinity of the surface to be coated by at least one of translating and rotating the die-receiving portion.

* * * * *